US005484690A

United States Patent [19]

Goto

[11] Patent Number: 5,484,690

[45] Date of Patent: Jan. 16, 1996

[54] SILVER HALIDE PHOTOGRAPHIC MATERIAL

[75] Inventor: Takahiro Goto, Kanagawa, Japan

[73] Assignee: Fuji Photo Film Co., Ltd., Kanagawa, Japan

[21] Appl. No.: 259,127

[22] Filed: Jun. 13, 1994

Related U.S. Application Data

[63] Continuation of Ser. No. 101,818, Aug. 4, 1993, abandoned, which is a continuation of Ser. No. 757,764, Sep. 11, 1991, abandoned.

[30] Foreign Application Priority Data

Sep. 13, 1990 [JP] Japan ..... 2-242985

[51] Int. Cl.[6] ..... G03C 1/09; G03C 5/29

[52] U.S. Cl. ..... 430/435; 430/438; 430/439; 430/441; 430/566; 430/567; 430/603; 430/605; 430/607; 430/611; 430/963

[58] Field of Search ..... 430/435, 438, 430/439, 441, 566, 567, 603, 605, 607, 611, 963

[56] References Cited

U.S. PATENT DOCUMENTS

| | | | |
|---|---|---|---|
| 3,782,946 | 1/1974 | Arai et al. | 430/439 |
| 3,804,624 | 4/1974 | Arai et al. | 430/439 |
| 4,960,689 | 10/1990 | Nishikawa et al. | 430/603 |
| 5,043,256 | 8/1991 | Otani | 430/551 |
| 5,110,719 | 5/1992 | Shuto et al. | 430/607 |
| 5,126,234 | 6/1992 | Naruse et al. | 430/551 |
| 5,229,263 | 7/1993 | Yoshida et al. | 430/607 |

FOREIGN PATENT DOCUMENTS

| | | | |
|---|---|---|---|
| 350046 | 1/1990 | European Pat. Off. | 430/614 |
| 130283 | 3/1978 | Germany | 430/607 |

*Primary Examiner*—Janet C. Baxter
*Attorney, Agent, or Firm*—Sughrue, Mion, Zinn, Macpeak & Seas

[57] ABSTRACT

A silver halide photographic material is disclosed, comprising a support having thereon one or more hydrophilic colloid layers, at least one of the hydrophilic colloid layers being a silver halide emulsion layer comprising silver halide grains with a silver chloride content of at least 90 mol %, wherein at least one hydrophilic colloid layer contains at least one compound selected from the compounds represented by formulae (I), (II) and (III); and at least one compound selected from the compounds represented by formulae (A), (B) and (C):

(I)

(II)

(III)

(A)

$$Z-SO_2-S-M$$

(B)

(C)

wherein the substituents are as defined in the claims. The silver halide photographic material can be handled in an environment which can essentially be referred to as bright room.

25 Claims, No Drawings

SILVER HALIDE PHOTOGRAPHIC MATERIAL

This is a Continuation of application Ser. No. 08/101,818 filed Aug. 4, 1993, now abandoned, which is a Continuation of application Ser. No. 07/757,764 filed Sep. 11, 1991, now abandoned.

FIELD OF THE INVENTION

The present invention relates to a silver halide photographic material, and in particular to a silver halide photographic material which can be handled in an environment which can essentially be referred to as a bright room environment.

BACKGROUND OF THE INVENTION

In the field of print reproduction, there is a demand for improvements in the operational efficiency of the photographic platemaking process in order to cope with the diversity and complexity of the print.

In particular, improvements in the operational efficiency have been provided for in the operations of lay-out process and contact work by carrying out these operations in brighter environments, and there have, therefore, been developments in exposure printers and in silver halide photographic materials for platemaking which can be handled in an environment which can essentially be referred to as a bright room environment.

The bright-room silver halide photographic materials referred to herein are photographic materials with which light of a wavelength of 400 nm or more and which does not include any ultraviolet component is used as the safelight.

Bright-room silver halide photographic materials used in lay-out process and contact work are photographic materials used in negative/positive conversion or positive/negative conversion by the contact exposure of an original with a silver halide photographic material for contact work, where the original is a developed film on which a character or halftone image has been formed. These photographic materials should have the following characteristics:

(1) a negative/positive conversion performance such that the halftone image and the line and character images respectively correspond to the halftone surface area and the line width and character-image width, and (2) a performance allowing tone adjustment in the halftone image and line-width adjustment in the character and line images.

Corresponding bright-room silver halide photographic materials for contact work have already been proposed.

However, tone adjustment of the halftone image by bright-room contact work using bright-room silver halide photographic materials is disadvantageous because, when there has been underexposure, marked deterioration is likely to occur in the density of the portion which is essentially expected to turn black by developing the whole surface.

Methods for obtaining a contrasty Dm (maximum density on characteristic curve) increase by including a developing agent in the silver halide photographic material have been disclosed in, for example, U.S. Pat. No. 4,617,258, JP-A-59-171947, JP-A-59-206828 and JP-A-1-262533 (the term "JP-A" as used herein means an "unexamined published Japanese patent application"), but these do not satisfy all the safelight, storage stability and Dm performance criteria. Further, JP-A-1-237538 discloses a method for improving the storage stability by including thiosulfinic acid in the silver halide photographic material.

SUMMARY OF THE INVENTION

It is therefore an object of this invention to provide a silver halide photographic material which gives an image quality of contact work with little deterioration in density upon underexposure by using a bright-room silver halide photographic material which can be handled in a bright-room environment.

This and other objects and advantages of the present invention are achieved by means of a silver halide photographic material comprising a support having thereon one or more hydrophilic colloid layers, wherein at least one hydrophilic colloid layer is a silver halide emulsion layer comprising silver halide grains with a silver chloride content of at least 90 mol %, wherein at least one hydrophilic colloid layer comprises (A) at least: one compound selected from compounds represented by formulae (I), (II) and (III); and (B) at least one compound selected from compounds represented by formulae (A), (B) and (C):

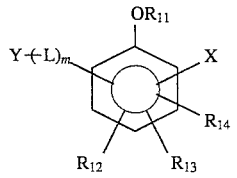

(I)

wherein X represents $OR_{11}$ or $N(R_{15})R_{16}$; $R_{11}$ represents a hydrogen atom or a group which can become a hydrogen atom by hydrolysis; $R_{12}$, $R_{13}$ and $R_{14}$ each represents a hydrogen atom or a substituent; $R_{12}$, $R_{13}$ and $R_{14}$ may be the same or different, and when any two of $R_{12}$, $R_{13}$ and $R_{14}$ have been substituted on neighboring carbon atoms in the benzene ring, they may link to form a carbocyclic or heterocyclic 5- to 7-membered ring wherein the ring may be saturated or unsaturated; $R_{15}$ and $R_{16}$ each represents a hydrogen atom, an alkyl group, an aryl group, an alkylsulfonyl group, an arylsulfonyl group, an alkylcarbonyl group, an arylcarbonyl group or a carbamoyl group, each of which may be substituted or unsubstituted; $R_{15}$ and $R_{16}$ may be identical or different and may link to form a nitrogen-containing heterocyclic ring; Y represents a group promoting adsorption onto the silver halide, L represents a divalent linking group; and m represents 0 or 1;

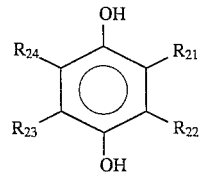

(II)

wherein $R_{21}$, $R_{22}$, $R_{23}$ and $R_{24}$ each represents a hydrogen atom, a hydroxyl group, a substituted or unsubstituted alkoxy group, a substituted or unsubstituted aryloxy group, a substituted or unsubstituted alkylthio group, a substituted or unsubstituted arylthio group, a halogen atom, a primary, secondary or tertiary amino group, a substituted or unsubstituted carboxamido group, a substituted or unsubstituted sulfonamido group, a substituted or unsubstituted alkyl group, a substituted or unsubstituted aryl group, a 5-membered or 6-membered heterocyclic group containing at least one N, O or S atom, a formyl group, a keto group, a sulfonic acid group, a carboxylic acid group, a substituted or unsubstituted alkylsulfonyl group or a substituted or unsubstituted arylsulfonyl group;

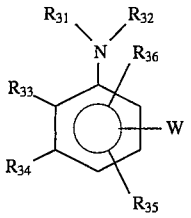

(III)

wherein W represents OH or $N(R_{31})R_{32}$; $R_{31}$ and $R_{32}$ each represents a hydrogen atom, an alkyl group, an aryl group, an alkylsulfonyl group, an arylsulfonyl group, an alkylcarbonyl group, an arylcarbonyl group or a carbamoyl group, each of which may be substituted or unsubstituted; $R_{31}$ and $R_{32}$ may be identical or different and may link to form a nitrogen-containing hetero ring; and $R_{33}$, $R_{34}$, $R_{35}$ and $R_{36}$ each represents a hydrogen atom or a substituent group; $R_{33}$, $R_{34}$, $R_{35}$ and $R_{36}$ may be identical or different; $R_{33}$ and $R_{34}$ may link to form a 5- to 7-membered carbocyclic or heterocyclic ring wherein the ring is saturated or unsaturated;

$$Z-SO_2-S-M \quad \text{(A)}$$

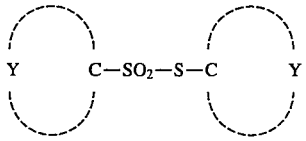

(B)

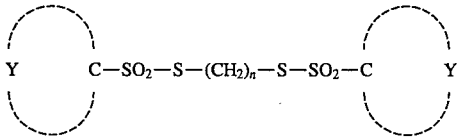

(C)

wherein Z represents an alkyl group having 1 to 18 carbon atoms, an aryl group having 6 to 18 carbon atoms or a heterocyclic group; Y represents an aromatic ring having 6 to 18 carbon atoms or atoms necessary to form a heterocyclic ring; Z and Y may be substituted or unsubstituted; M represents a metal atom or an organic cation; and n represents an integer of 2 to 10.

DETAILED DESCRIPTION OF THE INVENTION

A detailed explanation of compounds represented by formula (I) is shown below.

In formula (I), X represents $OR_{11}$ or $N(R_{15})R_{16}$; $R_{11}$ represents a hydrogen atom or a group which can become a hydrogen atom by hydrolysis; $R_{12}R_{13}$ and $R_{14}$ each represents a hydrogen atom or a substituent group; $R_{15}$ and $R_{16}$ each represents a hydrogen atom, an alkyl group, an aryl group, an alkylsulfonyl group, an arylsulfonyl group, an alkylcarbonyl group, an arylcarbonyl group or a carbamoyl group each of which may be substituted or unsubstituted; Y is a group promoting adsorption onto the silver halide; L represents a divalent linking group; and m represents 0 or 1.

Groups representing $R_{11}$ which can become hydrogen atoms by hydrolysis, include, for example, $-COR_{17}$ (wherein $R_{17}$ represents a substituted or unsubstituted alkyl group, a substituted or unsubstituted aryl group or a substituted or unsubstituted amino group) and

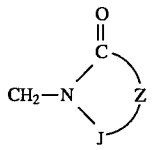

(wherein J represents

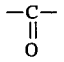

or $-SO_2-$ and Z represents a plurality of atoms needed to form at least one 5-membered or 6-membered ring).

Substituent groups representing $R_{12}$, $R_{13}$ and $R_{14}$ include the following groups, a halogen atom (fluorine, chlorine, bromine), an alkyl group (preferably having 1 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an acyl group (preferably having 2 to 20 carbon atoms), an acylamino group (preferably an alkanoylamino group having 1 to 20 carbon atoms or a benzoylamino group having 6 to 20 carbon atoms), a nitro group, a cyano group, an oxycarbonyl group (preferably an alkoxycarbonyl group having 1 to 20 carbon atoms or an aryloxycarbonyl group having 6 to 20 carbon atoms), a carboxy group, a sulfo group, a ureido group (preferably an alkylureido group having 1 to 20 carbon atoms or an arylureido group having 6 to 20 carbon atoms), a sulfonamido groups (preferably an alkylsulfonamido group having 1 to 20 carbon atoms or an arylsulfonamido group having 6 to 20 carbon atoms), a sulfamoyl group (preferably an alkylsulfamoyl group having 1 to 20 carbon atoms or an arylsulfamoyl group having 6 to 20 atoms), a carbamoyl group (preferably an alkylcarbamoyl group having 1 to 20 carbon atoms or an arylcarbamoyl group having 6 to 20 carbon atoms), an acyloxy group (preferably having 1 to 20 carbon atoms), an amino group (including an unsubstituted amino group, preferably a secondary or tertiary amino group substituted with an alkyl group having 1 to 20 carbon atoms or with an aryl group having 6 to 20 carbon atoms), a carbonic ester (preferably an alkyl carbonate having 1 to 20 carbon atoms or an aryl carbonate having 6 to 20 carbon atoms), a sulfonyl group (preferably an alkylsulfonyl group having 1 to 20 carbon atoms or an arylsulfonyl group having 6 to 20 carbon atoms), a sulfinyl group (preferably an alkylsulfinyl group having 1 to 20 carbon atoms or an arylsulfinyl group having 6 to 20 carbon atoms), a hydroxyl group and $-(L)_m-Y$ where L, Y and m have the same meaning as in general formula (I).

$R_{12}$, $R_{13}$ and $R_{14}$ may be the same or different and, when any two of $R_{12}$, $R_{13}$ and $R_{14}$ have been substituted on neighboring carbon atoms in the benzene ring, they may link to form a carbocyclic or heterocyclic 5-membered to 7-membered ring, and such rings may be saturated or unsaturated.

Examples of specific rings which can be formed by $R_{12}$, $R_{13}$ and $R_{14}$ include cyclopentane, cyclohexane, cycloheptane, cyclopentene, cyclohexadiene, cycloheptadiene, indan, norbornane, norbornene, pyridine and the like, and these may have substituent groups.

Further, the total number of carbon atoms in each of groups representing $R_{12}$, $R_{13}$ and $R_{14}$ is preferably 1 to 10.

$R_{15}$ and $R_{16}$ each represent a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group or a substituted or unsubstituted carbamoyl group. $R_{15}$ and $R_{16}$ may be identical or different and may link to form a nitrogen-containing heterocyclic ring (for example morpholino, piperidino, pyrrolidino, imidazolyl, piperazino or the like).

Substituent groups for $R_{15}$ and $R_{16}$ include $—(L)_m—Y$, where L, m and Y have the same meaning as in general formula (I), and those mentioned as substituent groups for $R_{12}$, $R_{13}$ and $R_{14}$. Hydrogen atoms are preferred as $R_{15}$ and $R_{16}$.

X is preferably substituted with respect to the group $—OR_{11}$ in the ortho-position or the para-position. $—OR_{11}$ is preferred among those groups represented by X and a hydrogen atom is preferred as $R_{11}$. When X is $OR_{11}$, the two $OR_{11}$ groups which would then be present on the benzene ring can be the same or different.

Y is a group promoting adsorption onto the silver halide, and L is a divalent linking group; and m is 0 or 1. Preferred examples of groups represented by Y promoting adsorption onto the silver halide include a thioamido group, a mercapto group, a group having a disulfide bond and a 5-membered or a 6-membered nitrogen-containing heterocyclic group.

The thioamido adsorption-promoting groups represented by Y are divalent groups represented by $$—\overset{\overset{\displaystyle S}{\|}}{C}—$$

amino-, and may either be a part of a ring structure or may be a non-cyclic thioamido group. Useful thioamido adsorption-promoting groups can be chosen from those disclosed in U.S. Pat. Nos. 4,030,925, 4,031,127, 4,080,207, 4,245,037, 4,255,511, 4,266,013 and 4,276,364 and in *Research Disclosure,* Vol. 151, No. 15162 (November, 1976) and Vol. 176, No. 17626 (December, 1978).

Specific examples of non-cyclic thioamido groups include, for example, a thioureido group, a thiourethane group, a dithiocarbamic acid ester and the like, and specific examples of cyclic thioamido groups include, for example, 4-thiazoline- 2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione, and these may be further substituted.

The mercapto group for Y includes an aliphatic mercapto group, an aromatic mercapto group and a heterocyclic mercapto group (when the atom next to the carbon atom to which the —SH group is bonded is nitrogen, this also signifies a tautomerically related cyclic thioamido group where specific examples of these groups are the same as those given above).

The groups having a disulfide bond represented by Y have —S—S—, and may either be a part of a ring structure or may be a non-cyclic group.

The 5-membered and 6-membered nitrogen-containing heterocyclic groups represented by Y include 5-membered and 6-membered nitrogen-containing hetero rings comprising combinations of nitrogen, oxygen, sulfur and carbon. Preferred examples include benzotriazole, triazole, tetrazole, indazole, benzimidazole, imidazole, benzothiazole, thiazole, benzoxazole, oxazole, thiadiazole, oxadiazole and triazine. These may be further substituted with suitable substituent groups.

Substituent groups which can be present on Y include those given as substituent groups for $R_{12}R_{13}$ and $R_{14}$.

Among the structures represented by Y, preference is given to a cyclic thioamido group (in other words, mercapto-substituted nitrogen-containing hetero rings such as 2-mercaptothiadiazole, 3-mercapto-1,2,4-triazole, 5-mercaptotetrazole, 2-mercapto-1,3,4-oxadiazole and 2-mercaptobenzoxazole) or nitrogen-containing hetero rings (such as benzotriazole, benzimidazole and indazole).

When $R_{11}$, $R_{12}$, $R_{13}$, $R_{14}$, $R_{15}$ or $R_{16}$ contains a $Y—(L)_m—$ group, then two or more $Y—(L)_m—$ groups are present in the compound of formula (I), and the two or more of the $Y—(L)_m—$ group may be substituted, and may be identical or different.

The divalent linking group represented by L is an atom or group of atoms including at least one of C, N, S and O. More specifically, it is, for example, an alkylene group, an alkenylene group, an alkynylene group, an arylene group, —O—, — S—, —NH—, —N=, —CO—, $—SO_2—$ (and these groups may have substituent groups) or the like, either singly or in combination.

Specific examples include:

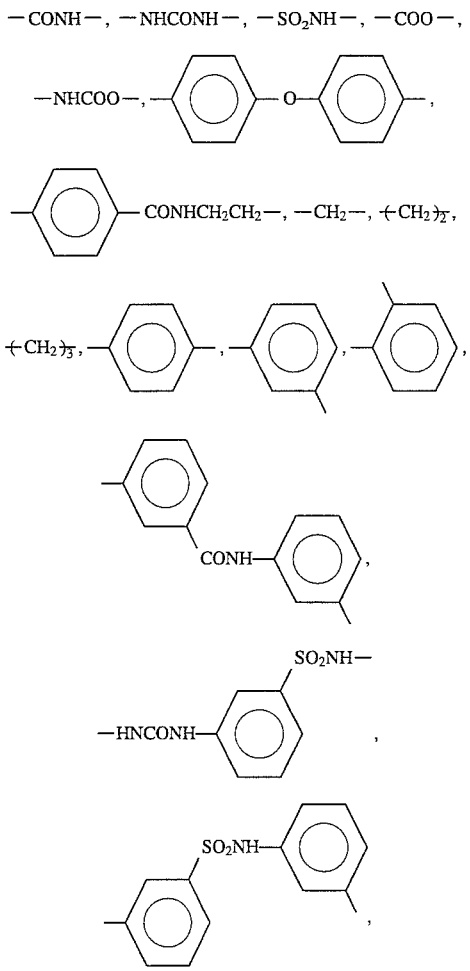

-continued
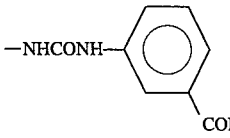
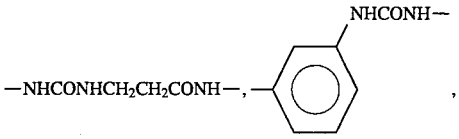
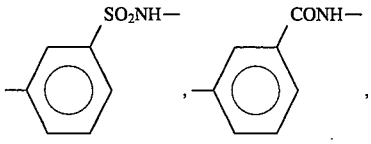
$-CH_2CH_2SO_2NH-$, $-CH_2CH_2CONH-$.
These may be further substituted with suitable substituent groups. Substituent groups include those given as substituent groups for $R_{12}$, $R_{13}$ and $R_{14}$.
Preferred specific examples of compounds represented by formula (I) are given below, but the scope of the present invention is not limited by these.
I-1
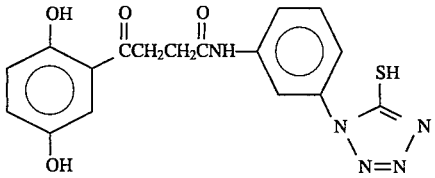
I-2
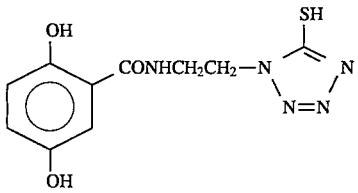
I-3
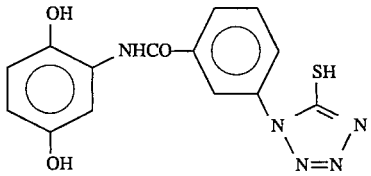
I-4
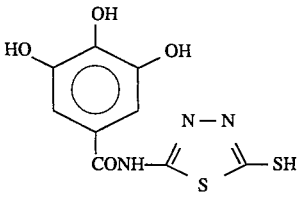
I-5
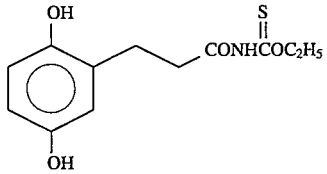
-continued
I-6
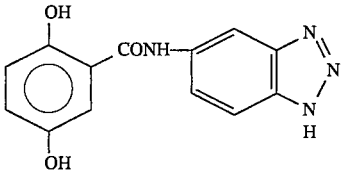
I-7
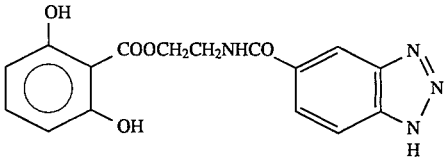
I-8
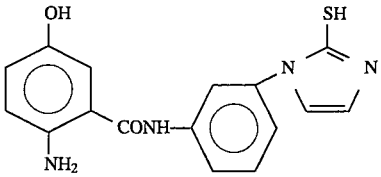
I-9
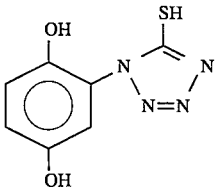
I-10
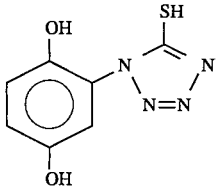
I-11
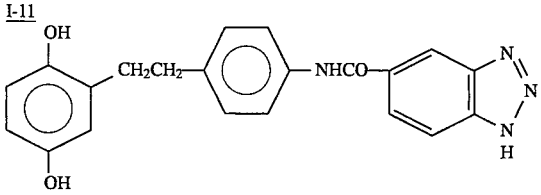
I-12
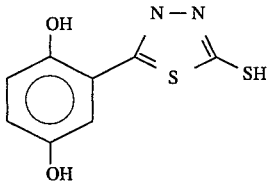
I-13
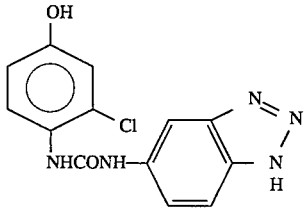

-continued

I-14

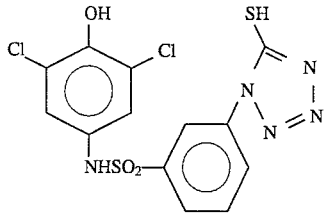

I-15

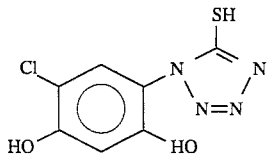

I-16

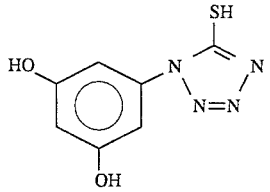

I-17

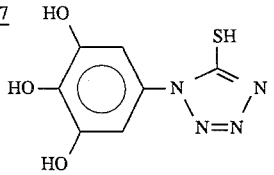

I-18

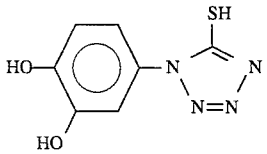

I-19

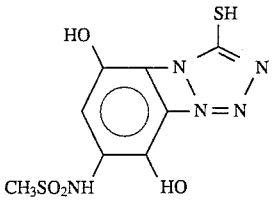

I-20

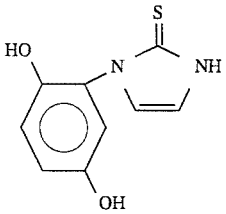

I-21

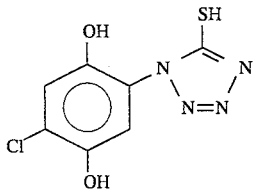

-continued

I-22

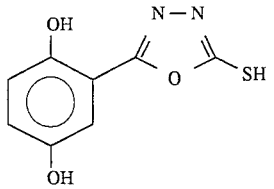

I-23

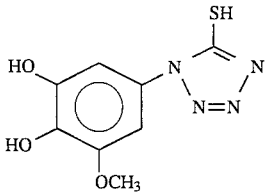

An example of a typical method of synthesizing compounds of formula (I) is now given with reference to a synthesis example.

Synthesis Example (Synthesis of compound I-11)

23.8 g (0.1 mole) of 5-phenylbenzotriazole carbonate, 25.2 g (0.11 mole) of 2-(4-aminophenyl)ethylhydroquinone and 100 ml of DMAC(dimethylacetamide) were heated and stirred for 5 hours in an oil solution at 120° C. (external temperature) in a nitrogen stream. Following this, the DMAC was distilled off under reduced pressure and 200 ml of methanol were added, whereupon a small amount of a black crystalline by-product remained as an insoluble fraction. The reaction mixture obtained by filtering off the insoluble fraction by suction filtration and distilling off the methanol under reduced pressure was isolated and purified in a silica gel column (chloroform/methanol=4/1) and washed in methanol to obtain the target product I-11. Yield 14.4 (38.5 %), melting point 256°–7° C.

The compound represented by formula (I) is preferably included in an amount of $1\times10^{-5}$ mol to $1\times10^{-1}$ mol per mol of silver halide, and is particularly preferably added in an amount of $1\times10^{-4}$ to $5\times10^{-2}$ mol per mol of silver halide.

When such compounds of formula (I) are to be included in the photographic material, they may be added to the silver halide emulsion solution or the hydrophilic colloid solution either as aqueous solutions when they are water-soluble or as solutions in water-miscible organic solvents such as alcohols (for example methanol, ethanol), esters (for example ethyl acetate) and ketones (for example acetone) when they are water-insoluble.

When they are added to the silver halide emulsion solution, they may be added at any desired time from the beginning of chemical ripening to coating, but they are preferably added after the completion of chemical ripening and they are particularly preferably added to the coating solution once it is ready for coating.

Compounds used in the present invention and represented by formula (II) are now discussed.

In formula (II), $R_{21}$, $R_{22}$, $R_{23}$ and $R_{24}$ each independently are a hydrogen atom, a hydroxyl group, a substituted or unsubstituted alkoxy group, a substituted or unsubstituted aryloxy group, a substituted or unsubstituted alkylthio group, a substituted or unsubstituted arylthio group, a halogen atom, a primary, secondary or tertiary amino group, a substituted or unsubstituted carboxamido group, a substituted or unsubstituted sulfonamido group, a substituted or unsubstituted alkyl group, a substituted or unsubstituted aryl group, a substituted or unsubstituted 5- or 6-membered heterocyclic group containing at least one N, O or S atom, a formyl group, a keto group, a sulfonic acid group, a carboxylic acid group, a substituted or unsubstituted alkylsulfonyl group, or a substituted or unsubstituted arylsulfonyl group.

Specific examples of compounds of formula (II) include those given, inter alia, in the Merck Index 10th edition (1983) as well as in U.S. Pat. Nos. 2,728,659, 3,700,453, 3,227,552, JP-A- 49-106329, JP-A-50-156438, JP-A-56-109344, JP-A-57-22237, JP-A- 59-202465, JP-A-58-17431, JP-B-50-21249, JP-B-56-40818, JP-B-59-37497 (the term "JP-B" as used herein means an "examined Japanese patent publication), British Patents 752146, 1086208, West German Patent Application (OLS) 2,149,789, and JP-A-57-17949. Particularly preferred among these dihydroxybenzene compounds of formula (IX) are unsubstituted hydroquinone and those where the sum of the Hammett's sigma values of the substituent groups apart from the two hydroxyl groups is −1.2 to +1.2, and particularly preferably −1.0 to +0.5.

Specific examples of these dihydroxybenzenes are given below, but the present invention is not limited to these.

II-1

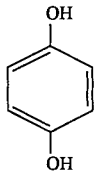

II-2

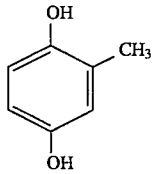

II-3

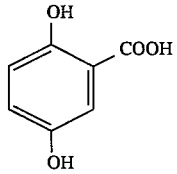

II-4

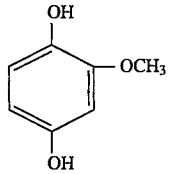

II-5

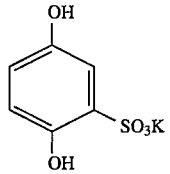

-continued

II-6

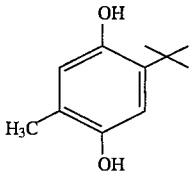

II-7

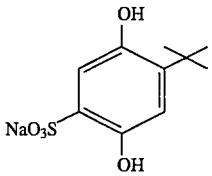

II-8

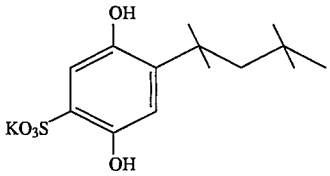

II-9

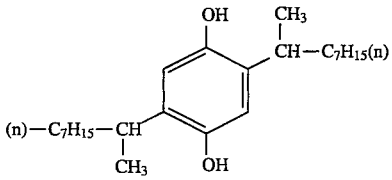

II-10

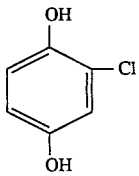

II-11

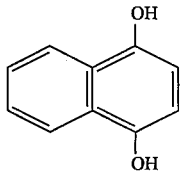

II-12

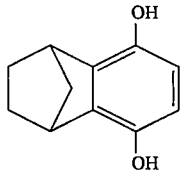

II-13

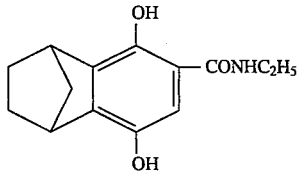

II-14

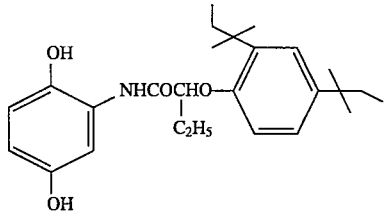

-continued

II-15

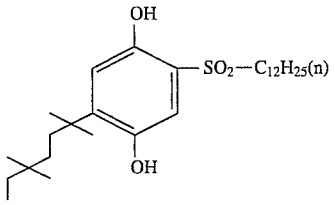

II-16

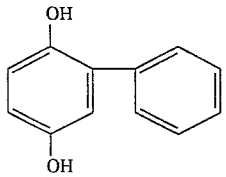

II-17

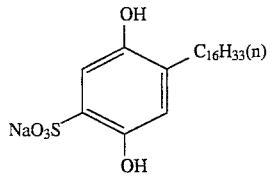

II-18

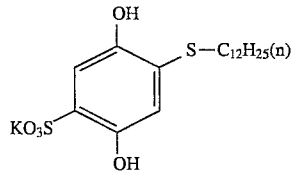

II-19

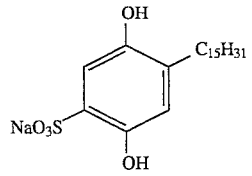

II-20

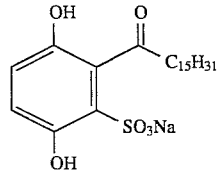

An explanation is now given of the compounds of formula (III) used in the present invention.

In formula (III), W represents OH or $N(R_{31})R_{32}$, $R_{31}$ and $R_{32}$ each independently represent a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group; and $R_{33}$, $R_{34}$, $R_{35}$ and $R_{36}$ each independently represent a hydrogen atom or a substituent group $R_{31}$ and $R_{32}$ may be identical or different and they may link to form a nitrogen-containing hetero ring (for example morpholino, piperidino, pyrrolidino, imidazolyl, piperazino or the like).

Hydrogen atoms are most preferred for $R_{31}$ and $R_{32}$.

$R_{33}$, $R_{34}$, $R_{35}$ and $R_{36}$ may be identical or different, and $R_{33}$ and $R_{34}$ may link to form a 5- to 7-membered carbocyclic or heterocyclic ring, and these rings may be saturated or unsaturated.

Substituent groups representing $R_{33}$, $R_{34}$, $R_{35}$ and $R_{36}$ include the following group, a halogen atom (fluorine, chlorine, bromine), an alkyl group (preferably having 1 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an acyl group (preferably having 2 to 20 carbon atoms), an acylamino group (preferably an alkanoylamino group having 1 to 20 carbon atoms or a benzoylamino group having 6 to 20 carbon atoms), a nitro group, a cyano group, an oxycarbonyl groups (preferably an alkoxycarbonyl group having 1 to 20 carbon atoms or an aryloxycarbonyl group having 6 to 20 carbon atoms), a carboxy group, a sulfo group, a ureido group (preferably an alkylureido group having 1 to 20 carbon atoms or an arylureido group having 6 to 20 carbon atoms), a sulfonamido group (preferably an alkylsulfonamido group having 1 to 20 carbon atoms or an arylsulfonamido group having 6 to 20 carbon atoms), a sulfamoyl group (preferably an alkylsulfamoyl group having 1 to 20 carbon atoms or an arylsulfamoyl group having 6 to 20 atoms), a carbamoyl group (preferably an alkylcarbamoyl group having 1 to 20 carbon atoms or an arylcarbamoyl group having 6 to 20 carbon atoms), an acyloxy group (preferably having 1 to 20 carbon atoms), an amino group (including an unsubstituted amino, preferably a secondary or tertiary amino group substituted with an alkyl group having 1 to 20 carbon atoms or with an aryl group having 6 to 20 carbon atoms), a carbonic ester (preferably an alkyl carbonate having 1 to 20 carbon atoms or an aryl carbonate having 6 to 20 carbon atoms), a sulfonyl group (preferably an alkylsulfonyl group having 1 to 20 carbon atoms or an arylsulfonyl group having 6 to 20 carbon atoms) and a sulfinyl group (preferably an alkylsulfinyl group having 1 to 20 carbon atoms or an arylsulfinyl group having 6 to 20 carbon atoms).

When $R_{33}$ and $R_{34}$ link to form a ring, the ring can be cyclopentane, cyclohexane, cycloheptane, cyclopentene, cyclohexadiene, cycloheptadiene, indan, norbornane, norbornene, pyridine and the like, and these may also have substituent groups.

Further, structures in which the total number of carbon atoms of each of $R_{33}$, $R_{34}$, $R_{35}$ and $R_{36}$ is 1 to 10 are preferred.

W is preferably substituted in the ortho-position or para-position with respect to the —$N(R_{31})R_{32}$ group, and the OH group is more preferred among those represented by W. When W represents —$N(R_{31})(R_{32})$, the two —$N(R_{31})(R_{32})$ groups which would then be present on the benzene ring can be the same or different.

It is preferable that at least one of $R_{33}$, $R_{34}$, $R_{35}$ and $R_{36}$ is not a hydrogen atom, and it is more preferable that W is the OH group and $R_{31}$ and $R_{32}$ are hydrogen atoms.

Preferred specific examples of compounds represented by formula (III) are given below, but the scope of the present invention is not limited to these.

III-1

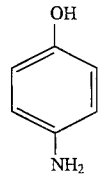

-continued
III-2
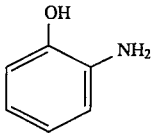
III-3
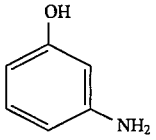
III-4
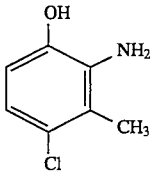
III-5
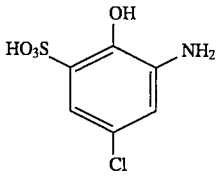
III-6
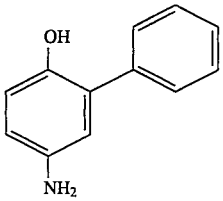
III-7
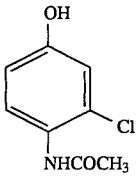
III-8
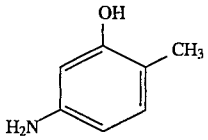
III-9
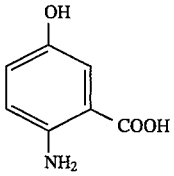
III-10
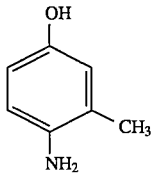
-continued
III-11
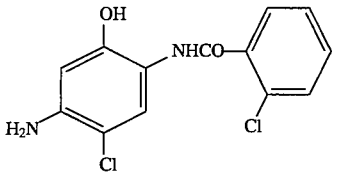
III-12
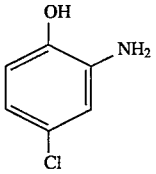
III-13
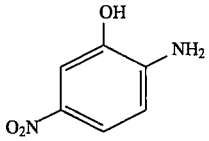
III-14
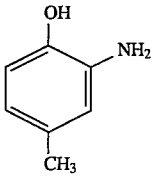
III-15
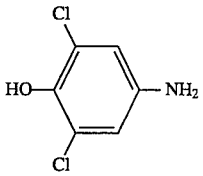
III-16
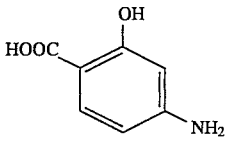
III-17
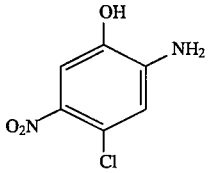
III-18
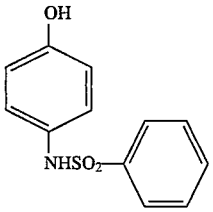
III-19
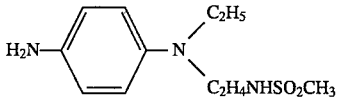

-continued

III-20

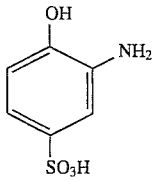

III-21

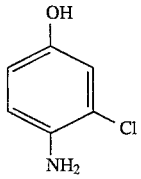

III-22

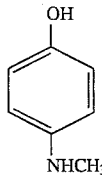

III-23

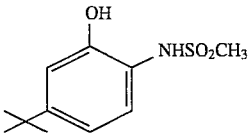

III-24

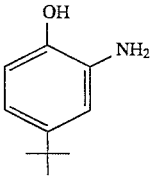

III-25

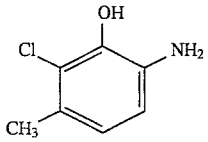

III-26

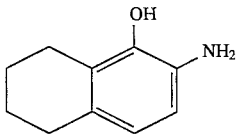

The compounds represented by formula (II) are preferably included in an amount of $1\times10^{-6}$ mol to $5\times10^{-1}$ mol per mol of silver halide, and the range $1\times10^{-5}$ mol to $8\times10^{-2}$ mol is a particularly preferred addition amount.

Further, the compounds represented by formula (III) are preferably included in an amount of $1\times10^{-5}$ mol to $1\times10^{-1}$ mol per mol of silver halide, and the range $1\times10^{-4}$ mol to $5\times10^{-2}$ mol is a particularly preferred addition amount.

When these compounds of formulae (II) and (III) are included in the photographic material, they are added to the silver halide emulsion solution or the hydrophilic colloid solution as aqueous solutions when they are water soluble, and, when they are water insoluble, they are added as solutions in water-miscible organic solvents such as alcohols (for example methanol and ethanol), esters (for example ethyl acetate) and ketones (for example acetone).

When they are added to the silver halide emulsion solution, they may be added at any desired time from the start of chemical ripening until coating, but they are preferably added after the completion of chemical ripening, and they are particularly preferably added to the coating solution once it is ready for coating.

A detailed explanation is now given of formulae (A), (B) and (C) used in the present invention.

The alkyl group, aryl group, heterocyclic group, aromatic ring and heterocyclic ring represented by Z and Y in formulae (A), (B) and (C) may be substituted or unsubstituted.

Substituent groups which can be present in Z and Y include, for example, a lower alkyl group such as a methyl group and an ethyl group, an aryl group such as a phenyl group, an alkoxy group having 1 to 8 carbon atoms, a halogen atom such as chlorine, a nitro group, an amino group and a carboxyl group.

Heterocyclic rings represented by Z and Y include thiazole, benzothiazole, imidazole, benzimidazole and oxazole rings and the like.

Preference is given to alkali metal atoms such as sodium ions, potassium ions and lithium ions as the metal atoms represented by M, and to ammonium ions, triethylammonium ions and the guanidine group as organic cations.

An alkyl group with 1 to 12 carbon atoms is the preferred group for Z.

The following compounds can be mentioned as specific examples of compounds represented by formulae (A), (B) and (C). However, the compounds represented by formulae (A), (B) and (C) are not limited to these examples.

1 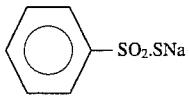

2 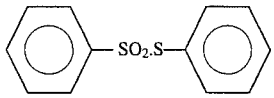

3 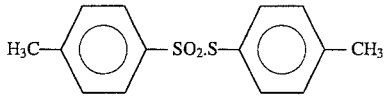

4 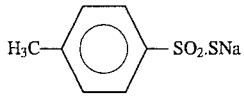

5 $H_3C.SO_2.SNa$

6 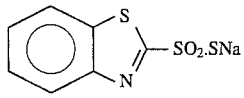

7 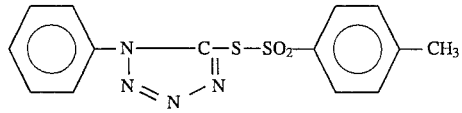

8 $nC_8H_{17}SO_2.SNa$
9 $nC_{12}H_{25}SO_2.SNa$
10 $nC_{16}H_{33}SO_2.SNa$

11 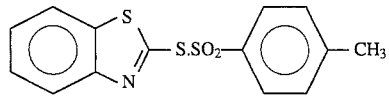

12 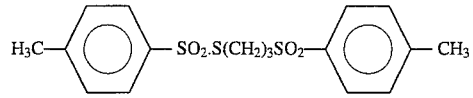

-continued

13 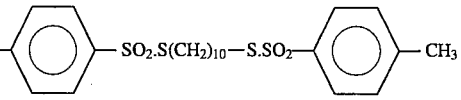

14 1-Cystine-disulfoxide
15 $C_2H_5.SO_2.SNa$
16 $C_4H_9.SO_2.SNa$

The compounds included among formulae (A), (B) and (C) can generally be synthesized by well-known methods.

For example, they can be synthesized by a method in which the appropriate sulfonyl fluoride and sodium sulfate are reacted, or in which the appropriate sodium sulfinate and sulfur are reacted. On the other hand, these compounds can be readily acquired as commercial products.

In the present invention, the addition amounts of the compounds represented by formulae (A), (B) and (C) are preferably $1\times10^{-5}$ mol to $1\times10^{-3}$ mol, and particularly preferably $5\times10^{-5}$ mol to $1\times10^{-3}$ mol per mol of silver halide. The time at which they are added is during grain formation, during chemical ripening or immediately before coating. Immediately before coating is particularly preferred.

The silver halide emulsion in the silver halide photographic material used in the present invention comprises a silver halide consisting of at least 90 mol % silver chloride, and is silver chlorobromide or silver chloroiodobromide containing 0 to 5 mol % of silver bromide. The higher the silver bromide or silver iodide ratio the worse the safelight safety in a bright room or the greater the reduction in the gamma, which is undesirable. A pure silver chloride emulsion is preferred for the present invention.

In the present invention, the silver halide photographic material must be handled in a substantially bright room. Therefore, the silver halide grains preferably contain rhodiumatoms since the presence of rhodium atoms in the silver halide grains provides the introduction of electron trap, and decreases the sensitivity and as a result, satisfactory safelight safety can be obtained.

In order to introduce rhodium atoms into the silver halide grains, the addition of the rhodium atoms can be made during grain preparation as any desired form of metal salt such as a single salt or complex salt.

The rhodium salt includes rhodium chloride, rhodium dichloride, rhodium trichloride, ammonium hexachlororhodate and the like, and it is preferably a water-soluble trivalent halogen complex of rhodium such as hexachlororhodic acid (III) or a salt thereof (the ammonium salt, sodium salt, potassium salt or the like).

The addition amount for these water-soluble rhodium salts is preferably from at least $1.0\times10^{-6}$ mol per mol of silver halide, more preferably $1.0\times10^{-6}$ mol to $1.0\times10^{-3}$ mol per mol of silver halide, and most preferably $5.0\times10^{-6}$ mol to $1.0\times10^{-4}$ mol per mol of silver halide.

It is not possible to obtain a satisfactorily enhanced contrast if there are $10^{-3}$ mol or more of the rhodium salt per mol of silver halide. Conversely, a low speed suitable for bright-room materials is not obtained if there is less than $10^{-6}$ mol per mol of silver halide.

The silver halide used in the present invention is preferably a core/shell silver halide, and is particularly preferably a core/shell silver halide where the rhodium content of the core is greater than that of the shell.

When a water-soluble silver salt and a water-soluble halide solution are simultaneously mixed in order to introduce the said water-soluble rhodium salt into the silver halide grains, preference is given to a method in which the addition is made to the water-soluble silver salt or the halide solution. Alternatively, the silver halide grains may be prepared by a simultaneous 3-bath mixing method using a third solution when the silver salt and halide solution are to be mixed simultaneously.

The grain size in the silver halide emulsion of the present invention is preferably 0.20 μm or less.

Good results can be obtained if the mixing conditions for the preparation of the fine silver halide grains in the present invention are adjusted so that the reaction temperature is 50° C. or less, preferably 40° C. or less and more preferably 30° C. or less, there is sufficiently high-speed stirring for uniform mixing and a silver potential of at least 70 mV and preferably 80 mV to 120 mV.

Basically, the grain size distribution is not restricted although it is preferably monodisperse. "Monodisperse" as used herein means that 95% of the grains, by weight or by number, is constituted by a group of grains with a size within ±40% and preferably within ±20% of the average grain size.

The silver halide grains of the present invention preferably have a cubic, octahedral or other such regular crystal form, and cubic is particularly preferred.

The silver halide emulsion used with the method of the present invention need not be chemically sensitized but it may be chemically sensitized. Sulfur sensitization, reduction sensitization and precious-metal sensitization are known as chemical sensitization methods for silver halide emulsions, and any of these may be used alone or they may be used jointly in order to carry out the chemical sensitization.

Gold sensitization is typical of precious-metal sensitization methods, and gold compounds, principally gold complex salts are used. There is no impediment to the inclusion of complex salts of metals other than gold such as platinum, palladium and iridium. Specific examples are given in, for example, U.S. Pat. No. 2,448,060 and G. B. Patent 618,061.

In addition to the sulfur compounds contained in gelatin, various sulfur compounds such as thiosulfates, thioureas, thiazoles and thiocyanates can be used as sulfur sensitizers.

Stannous salts, amines, formamidinesulfinic acid, silane compounds and the like can be used as reduction sensitizers.

The photographic materials produced using the present invention may contain water-soluble dyes as filter dyes in the hydrophilic colloid layers or for preventing irradiation and other such purposes. Such dyes include oxonol dyes, hemioxonol dyes, styryl dyes, merocyanine dyes, cyanine dyes and azo dyes. Of these, oxonol dyes, hemioxonol dyes and merocyanine dyes are the most useful.

Inorganic or organic film hardeners may be included in the photographic emulsions and light-insensitive hydrophilic colloids of the present invention.

For example, active vinyl compounds (such as 1,3,5-triacryloylhexahydro-s-triazine, bis(vinylsulfonyl)methyl ether and N,N-methylenebis-[β-(vinylsulfonyl)propionamide]), active halogen compounds (such as 2,4-dichloro-6-hydroxy-s-triazine), mucohalogenic acids (such as mucochloric acid), N-carbamoylpyridinium salts (such as (1-morpholinocarbonyl-3-pyridinio)methanesulfonate) and haloamidinium salts (such as 1-(1-chloro-1-pyridinomethylene)pyrrolidinium and 2-naphthalenesulfonate) can be used alone or in combination. Among these, preference is given to the active vinyl compounds in JP-A-53-41220, JP-A-53-57257, JP-A-59-162546 and JP-A-60-80846, and to the active halogen compounds given in U.S. Pat. No. 3,325,287.

The photographic emulsion layers and other hydrophilic colloid layers of the photographic material produced using the present invention may contain various surfactants for various purposes such as auxiliary coating, static prevention, improving sliding properties, emulsification dispersion, preventing sticking and improving photographic characteristics (for example accelerating development, hardening gradation and sensitization).

For example, it is possible to use nonionic surfactants such as saponin (steroid-type), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, or polyethylene oxide adducts of silicones), glycidol derivatives (for example, alkenylsuccinate polyglyceride and alkylphenol polyglyceride), fatty acid esters of polyhydric alcohols and alkyl esters of sugars; anionic surfactants which contain acidic groups such as the carboxyl group, sulfo group, phospho group, sulfuric acid ester group or phosphoric acid ester group such as alkyl carboxylates, alkyl sulfonates, alkylbenzenesulfonates, alkylnaphthalenesulfonates, alkyl sulfate esters, alkyl phosphate esters, N-acyl-N-alkyl taurines, sulfosuccinic acid esters, sulfoalkylpolyoxyethylene alkylphenyl ethers, polyoxyethylene alkylphosophate esters; amphoteric surfactants such as amino acids, aminoalkylsulfonates, aminoalkyl sulfuric acid or phosphoric acid esters, alkylbetaines and amine oxides; and cationic surfactants such as alkylamine salts, aliphatic or aromatic quaternary ammonium salts, pyridinium, imidazolium and other such heterocyclic quaternary ammonium salts and phosphonium or sulfonium salts containing aliphatic or heterocyclic rings.

Further, in order to prevent static, it is preferable to use the fluorine-containing surfactants given in, for example, JP-A-60-80849.

The photographic material of the present invention may contain silica, magnesium oxide, polymethyl methacrylate and other such matting agents in order to prevent sticking of the photographic emulsion layers and other hydrophilic colloid layers.

The photographic material used in the present invention can contain dispersions of synthetic polymers which are insoluble or sparingly soluble in water for the purpose of dimensional stability. Examples include polymers which have as their monomer constituents alkyl (meth)acrylate, alkoxyalkyl (meth)acrylate and glycidyl (meth)acrylate, either singly or in combination, or a combination of the above and acrylic acid, methacrylic acid or the like.

It is advantageous to use gelatin as the binding agent or protective colloid in the photographic emulsion, but other hydrophilic colloids can also be used. For example, it is possible to use various synthetic hydrophilic macromolecular substances such as gelatin derivatives, graft polymers of gelatin and other macromolecules, albumin, casein and other such proteins; hydroxyethylcellulose; carboxymethylcellulose; cellulose sulfate esters and other such cellulose derivatives; sodium alginate; starch derivatives and other such sugar derivatives; polyvinyl alcohol; polyvinyl alcohol partacetal; poly-N-vinylpyrrolidone; polyacrylic acid; polymethacrylic acid; polyacrylamide; polyvinyl imidazole; and polyvinyl pyrazole, either alone or as copolymers.

In addition to lime-treated gelatin, acid-treated gelatin may be used as the gelatin, and gelatin hydrolysis products or gelatin enzymolysis products can also be used.

The silver halide emulsion layers used in the present invention can contain polymer latexes such as alkyl acrylate.

Cellulose triacetate, cellulose diacetate, nitrocellulose, polystyrene, polyethylene terephthalate paper, baryta-coated paper, polyolefin-coated paper and the like can be used as the support for the photographic material of the present invention.

There are no particular limitations on the developing agent employed in the developing solution used in the present invention, but, in that a good halftone quality is readily obtained, it is preferable to include a dihydroxybenzene, and such cases include the use of a combination of a dihydroxybenzene and 1-phenyl-3-pyrazolidone and a combination of a dihydroxybenzene and a p-aminophenol.

The dihydroxybenzene developing agents used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Hydroquinone is particularly preferred.

The 1-phenyl-3-pyrazolidone or derivatives thereof used as a developing agent in the present invention include 1-phenyl-3-pyrazolidone, 1-phenyl-4,4-dimethyl-3-pyrazolidone, 1-phenyl-4-methyl-4-hydroxymethyl- 3-pyrazolidone, 1-phenyl -4,4-dihydroxymethyl- 3-pyrazolidone, 1-phenyl-5-methyl-3pyrazolidone, 1-p-aminophenyl-4,4-dimethyl-3-pyrazolidone, 1-p-tolyl- 4,4-dimethyl-3-pyrazolidone and 1-p-tolyl-4-methyl-4-hydroxymethyl- 3-pyrazolidone.

The p-aminophenol-based developing agents used in the present invention include N-methyl-p-aminophenol, p-aminophenol, N- (β-hydroxyethyl) -p-aminophenol, N- (4-hydroxyphenyl)glycine, 2-methyl-p-aminophenol and p-benzylaminophenol. Of these, N-methyl-p-aminophenol is preferred.

Normally, the developing agent is preferably used in an amount of 0.05 mol/l to 0.8 mol/l. Further, when using a combination of a dihydroxybenzene and a 1-phenyl-3-pyrazolidone or a p-aminophenol, the former is preferably used in an amount of 0.05 mol/l to 0.5 mol/l and the latter is preferably used in an amount of 0.06 mole/l or less.

Sulfite preservatives used in the present invention include sodium sulfite, potassium sulfite, lithium sulfite, ammonium sulfite, sodium bisulfite, potassium metabisulfite and sodium formaldehyde bisulfite. The sulfite is preferably used in an amount of 0.3 mol/l or more and particularly preferably 0.4 mol/l or more. Moreover, it is preferable to adopt an upper limit of 2.5 mol/l and more particularly of 1.2 mol/l.

The alkalies used to set the pH of the developing solution include pH adjusters and buffers such as sodium hydroxide, potassium hydroxide, sodium carbonate, potassium carbonate, sodium triphosphate, potassium triphosphate, sodium silicate and potassium silicate.

In addition to the above components, additives which may be used in the developing solution include development inhibitors such as sodium bromide, potassium bromide, potassium iodide and compounds such as boric acid and borax; organic solvents such as ethylene glycol, diethylene glycol, triethylene glycol, dimethylformamide, methyl cellosolve, hexylene glycol, ethanol, and methanol; and antifoggants such as mercapto compounds, for example, 1-phenyl-5-mercaptotetrazole and sodium-2-mercaptobenzimidazole-5-sulfonate, indazole compounds, for example, 5-nitroindazole, and benzotriazole compounds, for example, 5-methylbenzotriazole. In addition toners, surfactants, anti-foaming agents, water softeners, film hardeners and the like may also be included in the developing solution if required. Particular preference is given to the amino compounds described in JP-A-56-106244 and the imidazole compounds described in JP-B-48-35493 since they accelerate development or improve the photographic speed.

In the developing solution used in the present invention, it is possible to use the compounds described in JP-A-56-24347 as silver-staining preventing agents, the compounds given in JP-A-62-212651 as uneven development preventing agents and the compounds given in JP-A-61-267759 as auxiliary solvents.

Examples of buffering agents which can be employed in the developing solution used to develop the photographic material of the present invention include boric acid described in JP-A-62-186259, sugars (such as saccharose), oximes (such as acetoxime), phenols (such as 5-sulfosalicylic acid) and triphosphoric acid salts (such as the sodium salt and potassium salt) given in JP-A-60-93433. Boric acid is preferably used.

The fixing solution is an aqueous solution containing, as required, film hardeners (such as water-soluble aluminum compounds), acetic acid and dibasic acids (for example, tartaric acid, succinic acid and salts thereof), in addition to the fixing agents, and it preferably has a pH of 3.8 or more, and more preferably of 4.0 to 5.5.

Fixing agents include sodium thiosulfate, ammonium thiosulfate and the like, and ammonium thiosulfate is particularly preferred in view of its fixing rate. The amount of fixing agent used can be altered appropriately and is generally about 0.1 to about 5 mol/l.

The water-soluble aluminum salts acting mainly as film hardeners in the fixing solution are generally compounds known as film hardeners for acidic film-hardening fixing solutions, for example, aluminum chloride, aluminum sulfate, potash alum and the like.

Examples of the dibasic acids mentioned above include tartaric acid or derivatives thereof and succinic acid or derivatives thereof which are used alone or in combination. It is effective to include 0.005 mol or more of these compounds per liter of fixing solution, and 0.01 mol/l to 0.03 mol/l is particularly effective.

More specifical examples include tartaric acid, potassium tartrate, sodium tartrate, potassium sodium tartrate, ammonium tartrate, ammonium potassium tartrate.

Examples of the succinic acid or derivatives thereof which can be used in the fixing solution include succinic acid, sodium succinate and potassium succinate.

If desired, the fixing solution can also contain preservatives (such as sulfites and bisulfites), pH buffers (such as acetic acid and boric acid), pH adjusters (such as ammonia and sulfuric acid), image-storage enhancers (such as potassium iodide) and chelating agents. Here, 10 to 40 g/l, and more preferably 18 to 25 g/l of the pH buffer is used as the pH of the developing solution is high.

The fixing temperature and time are the same as for the development and are preferably about 20° C. to about 50° C. for 10 sec. to 1 min.

Further, the washing water may contain antifungal agents (such as the compounds given in *Bokin Bobai no Kagaku* (Antifungal and Antimicrobial Chemistry) by Horiguchi and in JP-A-62-115154), washing accelerators (such as sulfites) and chelating agents.

The developed and fixed photographic material is washed and dried. The washing is carried out so that the silver salts dissolved by fixing are more or less completely removed, and is preferably carried out at about 20° C. to about 50° C. for 10 sec. to 3 min. The drying is carried out at about 40° C. to about 100° C., and the drying time can be appropriately altered depending upon the surrounding conditions but is normally about 5 sec. to 3 min. 30 sec.

Automatic developing apparatuses of the roller conveyor type have been described in, for example, U.S. Pat. Nos. 3,025,799 and 3,545,971, and will simply be referred to as roller conveyor processors in the present specification. The roller conveyor processor involves the four stages of development, fixing, washing and drying and, while the photographic material of the present invention can be processed by a method which does not exclude other stages (such as a stop stage), it is most preferable to follow the four stages. Here, water-saving processing can be achieved in the washing stage by using a 2 or 3 step countercurrent washing system.

The developing solution used to develop the photographic material of the present invention is preferably stored in a packaging material with a low oxygen permeability described in JP-A-61-73147. Further, the replenishment system given in JP-A-62-91939 is preferably used with the developing solution used in the present invention.

Because the silver halide photographic material of the present invention provides a high Dmax, a high density is maintained even if the halftone surface area is reduced when a reducing process is performed after image formation.

There are no particular limitations on the reducing solution used to reduce the photographic material of the present invention, and, for example, it is possible to use those described in *The Theory of the Photographic Process* by Mees, pp. 738–744 (1954, Macmillan), *Shashin Shori, Sono Riron to Jissai* (Photographic Processing, Theory and Practice) by T. Yano, pp. 166–169 (1978, Kyoritsu Shuppan) and the like as well as in JP-A-50-27543, JP-A-52-68429, JP-A-55-17123, JP-A-55-79444, JP-A-57-10140, JP-A-57-142639 and JP-A-61-61155.

Acidifiers, permanganates, persulfates, ferric salts, cupric salts, ceric salts, ferricyanates, bichromates and the like can be used either singly or in combination, and it is possible to use reducing solutions containing alcohols and inorganic acids such as sulfuric acid if required, or to use reducing solutions containing ferricyanates and iron(III) ethylenediaminetetraacetate and other such acidifiers, thiosulfates, thiocyanates, thioureas or derivatives thereof and other such silver halide solvents and, if required, inorganic acids such as sulfuric acid.

Representative examples of reducing solutions which can be used with the photographic material of the present invention include the Farmer's reducing solution, iron(III) ethylenediaminetetraacetate, potassium permanganate and ammonium persulfate reducing solutions (Kodak R-5) and ceric salt reducing solutions.

The conditions for the reducing process are preferably a temperature of 10° C. to 40° C. and more preferably 15° C. to 30° C. so that it can be completed within several seconds to several tens of minutes and more particularly within several minutes. If the silver halide photographic material of the present invention is used, a sufficiently wide reduced width can be obtained within this range of conditions.

The reducing solution acts on the silver image formed in the emulsion layer.

More specifically, there are various procedures which can be used. For example, it is possible to use methods encompassing immersing the photographic material in the reducing solution and stirring the solution, or applying the reducing solution to the surface of the photographic material by such means as a brush or roller, or the like.

The present invention is explained more specifically by examples below, but the present invention is not limited by these examples.

A developing solution of the following formulation was used in the examples.

| | |
|---|---|
| Potassium sulfite | 67 g |
| Disodium ethylenediaminetetraacetate | 3.0 g |
| Hydroquinone | 23 g |
| 4-Hydroxymethyl-4-methyl-1-phenyl-3-pyrazolidone | 0.4 g |
| Sodium 2-mercaptobenzimidazole-5-sulfonate | 0.3 g |
| Potassium hydroxide | 11 g |
| 5-Methylbenzotriazole | 0.1 g |
| Sodium carbonate | 11 g |
| Potassium bromide | 3.0 g |
| Water to 1 l (adjusted to pH 10.7) | |

EXAMPLE

Preparation of emulsions

Emulsion A: Nucleation was carried out by adding an aqueous 2.9 mol/liter silver nitrate solution and an aqueous halogen salt solution containing 3.0 mol/liter sodium chloride and $5.3\times10^{-5}$ mol/liter of ammonium hexachlororhodate(III) to an aqueous gelatin solution of pH 2.0 containing sodium chloride, while stirring at a temperature of 38° C. and at a fixed potential of 100 mV for 4 minutes. 1 minute later, an aqueous 2.9 mol/liter silver nitrate solution and an aqueous halogen salt solution containing 3.0 mol/liter sodium chloride were added at 38° C., at half the speed at which the corresponding solutions were added during nucleation and at a fixed potential of 100 mV for 8 minutes. After this, washing was carried out by flocculation following the usual method, gelatin was added, adjustments made to pH 5.7 and pAg 7.4, and 5,6-trimethylene-7-hydroxy-s-triazolo(2,3-a)pyrimidine was added as a stabilizer in an amount of 0.05 mole per mole of silver. The resulting grains were cubic silver chloride grains with an average grain size of 0.13 μm and containing $8.0\times10^{-6}$ mol of Rh per mole of silver. (Variation coefficient: 11 %).

Emulsion B: Nucleation was carried out by adding an aqueous 2.9 mol/liter silver nitrate solution and an aqueous halogen salt solution containing 3.0 mol/liter sodium chloride and $2.0\times10^{-5}$ mol/liter ammonium hexachlororhodate(III) to an aqueous gelatin solution of pH 2.0 containing sodium chloride, while stirring at a temperature of 40° C. and at a fixed potential of 85 mV for 4 minutes. 1 minute later, an aqueous 2.9 mol/liter silver nitrate solution and an aqueous halogen salt solution containing 3.0 mol/liter sodium chloride were added at 40° C., at half the speed at which the corresponding solutions were added during nucleation and at a fixed potential of 85 mV for 8 minutes. After this, washing was carried out by flocculation following the usual method, gelatin was added, adjustments made to pH 5.7 and pAg 7.4, and 5,6-trimethylene-7-hydroxy-s-triazolo(2,3-a)pyrimidine was added as a stabilizer in an amount of $8\times10^{-3}$ mol per mole of silver and 6-methyl-4-hydroxy-1,3,3a,7-tetraazaindene was added as a stabilizer in an amount of $1.5\times10^{-3}$ mol per mole of silver. The resulting grains were cubic silver chloride grains with an average grain size of 0.16 μm and containing $3.0\times10^{-6}$ mol of Rh per mole of silver. (Variation coefficient: 12%).

Emulsion C: Nucleation was carried out by adding an aqueous 2.9 mol/liter silver nitrate solution and an aqueous halogen salt solution containing 2.6 mol/liter sodiumchloride, 0.4 mol/liter potassium bromide and $5.3\times10^{-5}$ mol/liter ammonium hexachlororhodate(III) to an aqueous gelatin solution of pH 2.0 containing sodium chloride, while stirring at a temperature of 40° C. and at a fixed potential of 85 mV for 4 minutes. 1 minute later, an aqueous 2.9 mol/liter silver nitrate solution and an aqueous halogen salt solution containing 2.6 mol/liter sodium chloride and 0.4 mol/liter potassium bromide were added at 40° C., at half the speed at which the corresponding solutions were added during nucleation and at a fixed potential of 85 mV for 8 minutes. After this, washing was carried out by flocculation following the usual method, gelatin was added, adjustments made to pH 5.7 and pAg 7.4, and 6-methyl-4-hydroxy-1,3,3a,7-tetraazaindene was added as a stabilizer in an amount of $3.0\times10^{-3}$ mol per mol of silver. The resulting grains were cubic silver chlorobromide grains with an average grain size of 0.16 μm and containing $8.0\times10^{-6}$ mol of Rh per mole of silver. (Bromine content: 15%, variation coefficient: 12%).

Preparation of coated samples

The compounds of formulae (I) to (III) and the compounds of formulae (A) to (C) of the present invention were added to the Emulsions A, B and C as shown in the Table, and then 18 mg/m$^2$ of the following ultraviolet absorber (1) were added,

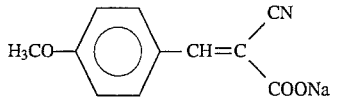

(1)

2.5 mg/m$^2$ of 1-phenyl-5-mercaptotetrazole and 770 mg/m$^2$ of ethyl acrylate latex (average particle size 0.05 μm) and 126 mg/m$^2$ of 2-bis(vinylsulfonylacetamido)ethane were added as a film hardener, and the product was coated onto a polyester support to a silver amount of 3.6 g/m$^2$. There was 1.5 g/m$^2$ of gelatin.

0.8 g/m$^2$ of gelatin, 8 mg/m$^2$ of lipoic acid and 230 mg/m$^2$ of ethyl acrylate latex (average particle size 0.05 μm) were coated onto this as a lower protective layer, and 0.5 g/m$^2$ of gelatin, 55 mg/m$^2$ of a matting agent (silicon dioxide, average particle size 3.5 μm), and 135 mg/m$^2$ of methylated silica (average particle size 0.02 μm) were coated on this as an upper protective layer while 25 mg/m$^2$ of sodium dodecylbenzenesulfonate, 20 mg/m$^2$ of the sodium salt of polyoxyethylene(degree of polymerization: 5)nonylphenylether sulfate and 3 mg/m$^2$ of N-perfluorooctanesulfonyl-N-propylglycine potassium salt were simultaneously coated as auxiliary coating agents to complete the preparation of the samples.

The base used in the present embodiment has a backing layer and a backing protection layer with the following compositions (swelling rate on the backing side 110%).

| | |
|---|---|
| (Backing layer) | |
| Gelatin | 170 mg/m$^2$ |
| Sodium dodecylbenzenesulfonate | 32 mg/m$^2$ |
| Sodium dihexyl α-sulfosuccinate | 35 mg/m$^2$ |
| $SnO_2$/Sb (9/1 weight ratio, average particle size 0.25 μm) | 318 mg/m$^2$ |
| (Backing protection layer) | |
| Gelatin | 2.7 g |
| Silicon dioxide matting agent (average particle size 3.5 μm) | 26 mg/m$^2$ |
| Sodium dihexyl α-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |
| Dye A | 190 mg/m$^2$ |
| Dye B | 32 mg/m$^2$ |
| Dye C | 59 mg/m$^2$ |
| Ethyl acrylate latex (average particle size 0.05 μm) | 260 mg/m$^2$ |
| 1,3-Divinylsulfonyl-2-propanol | 149 mg/m$^2$ |

Dye A

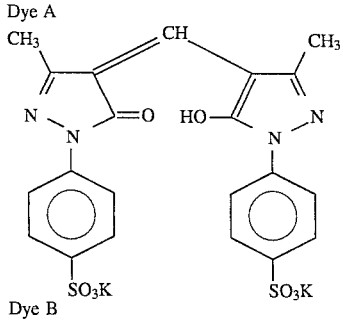

Dye B

-continued

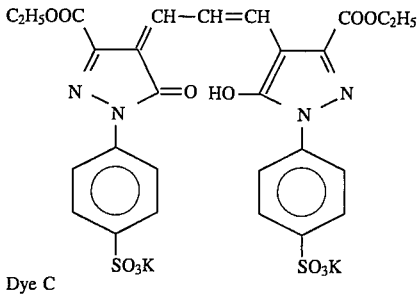

Dye C

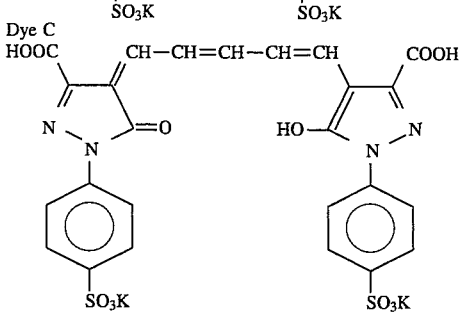

Photographic performance

The samples obtained in this way were exposed via an optical wedge using a P-617 DQ printer (quartz) made by the Dainippon Screen Mfg., Co., Ltd., developed for 20 seconds at 38° C., fixed, washed and dried (automatic developing apparatus FG-800 RA). The following aspects of these samples were evaluated.

1) Relative speed: the reciprocal of the exposure giving a density of 1.5, taking Sample 1 as 100.

2) Gamma: (3.0–0.3)±{log(exposure giving a density of 0.3)–log(exposure giving a density of 3.0)}

3) Dm and Dm(−1%): the products when a film (halftone original) with a halftone image formed on a transparent or translucent film base has been fixed by an adhesive tape were stuck in such a way that the protective layer of each film sample and the halftone original are brought into contact each other face to face, and the maximum blackening densities obtained upon effecting an exposure in such a way that the 50% halftone surface area became a 50% or 49% halftone surface area on the film samples were taken as Dm and Dm(−1%) respectively.

4) Storage (Δfog): a non-exposed films were left for 5 days under conditions of 60° C. and 30% RH and then developed at 38° C. for 20 seconds. Visual density with respect to four thicknesses of the thus prepared film was measured. On the other hand, a non-exposed film immediately after coating (fresh film) was developed at 38° C. for 20 seconds, and visual density with respect to four thicknesses of the thus prepared film was measured. Time storage (ΔFog) was represented by the change with respect to the density (difference of the density of the storage film to that of the fresh).

5) Fog after safelight irradiation: this is the fog upon placing the sharp cut filter SC-42 made by the Fuji Photo Film Co., Ltd. on a white fluorescent lamp (FL40sw) made by Toshiba, irradiating for 30 minutes at about 800 Lux and then carrying out a development process.

TABLE

| | | Compound of General Formulae (I) to (III) | | Compound of General Formulae (A) to (C) | |
|---|---|---|---|---|---|
| Sample | Emulsion | Compound No. | Amount added | Compound No. | Amount added |
| 1 | A | — | — | — | — |
| 2 | " | II-1 | 55 mg/m² | — | — |
| 3 | " | — | — | 15 | 10 mg/m² |
| 4 | " | II-1 | 55 mg/m² | " | " |
| 5 | " | I-9 | 10 mg/m² | " | " |
| 6 | " | " | " | 8 | 20 mg/m² |
| 7 | " | " | " | " | 30 mg/m² |
| 8 | B | — | — | — | — |
| 9 | " | II-1 | 100 mg/m² | — | — |
| 10 | " | — | — | 15 | 10 mg/m² |
| 11 | " | II-1 | 100 mg/m² | " | " |
| 12 | " | I-3 | 15 mg/m² | 1 | 20 mg/m² |
| 13 | " | " | 30 mg/m² | " | " |
| 14 | " | III-10 | 15 mg/m² | 16 | 15 mg/m² |
| 15 | " | " | " | " | 30 mg/m² |
| 16 | C | — | — | — | — |
| 17 | " | II-1 | 100 mg/m² | 15 | 10 mg/m² |
| 18 | " | I-9 | 10 mg/m² | " | " |

| | P-617DQ Exposure | | | | Time storage[4)] | Safelight[5)] | |
|---|---|---|---|---|---|---|---|
| Sample | Relative speed[1)] | Gamma[2)] | Dm[3)] | Dm (−1%)[3)] | ΔFog | Fog | |
| 1 | 100 | 7.4 | 5.4 | 4.3 | +0.22 | 0.08 | |
| 2 | 101 | 7.9 | 5.7 | 5.1 | +0.22 | 0.08 | |
| 3 | 97 | 7.2 | 5.2 | 4.0 | +0.04 | 0.09 | |
| 4 | 97 | 7.7 | 5.6 | 5.0 | +0.04 | 0.08 | Present Invention |
| 5 | 98 | 7.5 | 5.5 | 5.0 | +0.04 | 0.08 | Present Invention |
| 6 | 96 | 7.5 | 5.5 | 5.0 | +0.06 | 0.08 | Present |

TABLE-continued

| | | | | | | | |
|---|---|---|---|---|---|---|---|
| | | | | | | | Invention |
| 7 | 94 | 7.2 | 5.3 | 4.9 | +0.04 | 0.08 | Present Invention |
| 8 | 135 | 6.0 | 5.1 | 3.6 | +0.23 | 0.08 | |
| 9 | 136 | 6.5 | 5.4 | 4.8 | +0.23 | 0.08 | |
| 10 | 130 | 5.8 | 5.0 | 3.4 | +0.04 | 0.09 | |
| 11 | 131 | 6.3 | 5.4 | 4.7 | +0.05 | 0.09 | Present Invention |
| 12 | 132 | 6.4 | 5.6 | 4.9 | +0.04 | 0.08 | Present Invention |
| 13 | 133 | 6.5 | 5.6 | 5.1 | +0.04 | 0.08 | Present Invention |
| 14 | 133 | 6.5 | 5.5 | 4.9 | +0.06 | 0.08 | Present Invention |
| 15 | 132 | 6.4 | 5.5 | 4.9 | +0.04 | 0.08 | Present Invention |
| 16 | 120 | 5.5 | 5.1 | 3.2 | +0.24 | 1.20 | |
| 17 | 120 | 6.0 | 5.2 | 4.7 | +0.05 | 1.15 | |
| 18 | 118 | 6.0 | 5.3 | 4.9 | +0.05 | 1.16 | |

1), 2), 3), 4) and 5) refer to the evaluation of the samples noted above.

As is clear from the Table, with the samples of the present invention, there was little density reduction in contact work even in cases of underexposure Dm(−1%) and the storage properties and safelight performance are outstanding.

While the invention has been described in detail and with reference to specific embodiments thereof, it will be apparent to one skilled in the art that various changes and modifications can be made therein without departing from the spirit and scope thereof.

What is claimed is:

1. A method for forming a silver image in a black and white photographic material, comprising:

imagewise exposing a silver halide black and white photographic material comprising a support having thereon one or more hydrophilic colloid layers, wherein at least one hydrophilic colloid layer is a silver halide emulsion layer comprising silver halide grains with a silver chloride content of at least 90 mol %, and wherein at least one hydrophilic colloid layer comprises a silver halide emulsion layer comprising (A) a compound represented by formula (I); and (B) at least one compound selected from compounds represented by formulae (A), (B) and (C):

(I)

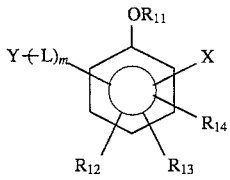

wherein X represents $OR_{11}$ or $N(R_{15})R_{16}$; $R_{11}$ represents a hydrogen atom or a group which can become a hydrogen atom by hydrolysis; $R_{12}$, $R_{13}$ and $R_{14}$ each represents a hydrogen atom or a substituent group selected from the group consisting of a halogen atom, an alkyl group, an aryl group, an alkyl group, an aryloxy group, an alkylthio, an arylthio group, an acyl group, an acylamino group, a nitro group, a cyano group, an oxycarbonyl group, a carboxy group, a sulfo group, a ureido group, a sulfonamido group, a sulfamoyl, a carbamoyl group, an acyloxy group, an amino group, a carbonic ester, a sulfonyl group, a sulfinyl group, a hydroxyl group and $—(L)_m—Y$ where L, Y and m are defined below; $R_{12}$, $R_{13}$ and $R_{14}$ may be the same or different, and when any two of $R_{12}$, $R_{13}$ and $R_{14}$ have been substituted on neighboring carbon atoms in the benzene ring, they may link to form a carbocyclic or heterocyclic 5-membered to 7-membered ring, wherein the ring may be saturated or unsaturated; $R_{15}$ and $R_{16}$ each represents a hydrogen atom, an alkyl group, an aryl group, an alkylsulfonyl group, an arylsulfonyl group, an alkylcarbonyl group, an arylcarbonyl group or a carbamoyl group; $R_{15}$ and $R_{16}$ may be identical or different and may link to form a nitrogen-containing heterocyclic ring; Y represents a group promoting adsorption onto the silver halide; L represents a divalent linking group and m represents 0 or 1;

$$Z—SO_2—S—M \quad (A)$$

(B)

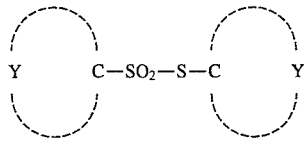

(C)

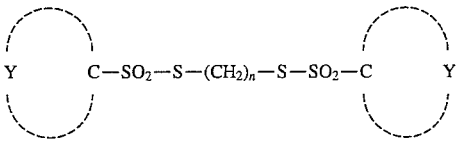

wherein Z represents an alkyl group having 1 to 18 carbon atoms, an aryl group having 6 to 18 carbon atoms or a heterocyclic group; Y represents an aromatic ring having 6 to 18 carbon atoms or atoms necessary to form a heterocyclic ring; M represents a metal atom or an organic cation; and n represents an integer of 2 to 10; and processing said photographic material with a black and white developer containing a dihydroxybenzene developing agent, wherein the silver halide grains are core/shell silver halide grains having rhodium atoms located in both the core and the shell, the rhodium atoms being present in the core in an amount greater than in the shell.

2. The method as in claim 1, wherein the silver halide grains contain at least $1\times10^{-6}$ mol of a rhodium salt per mole of silver halide.

3. The method as in claim 2, wherein the rhodium salt is selected from rhodium chloride, rhodium dichloride, rhodium trichloride and ammonium hexachlororhodate.

4. The method as in claim 2, wherein the silver halide grains comprise $1.0\times10^{-6}$ mol to $1.0\times10^{-3}$ mol of the rhodium salt per mol of silver halide.

5. The method as in claim 1, wherein the charged potential of the silver halide grains is at least 70 mV.

6. The method as in claim 5, wherein the charged potential of the silver halide grains is 80 mV to 120 mV.

7. The method as in claim 1, wherein the compound represented by formula (I) is present in an amount of from $1\times10^{-5}$ mol to $1\times10^{-1}$ mol per mol of silver halide.

8. The method as in claim 7, wherein the amount of the compound represented by formula (I) is from $1\times10^{-4}$ to $5\times10^{-2}$ mol per mol of silver halide.

9. The method as in claim 1, wherein the at least one compound selected from the compounds represented by formulae (A), (B) and (C) is present in an amount of $1\times10^{-5}$ mol to $1\times10^{-3}$ mol per mol of silver halide.

10. The method as in claim 9, wherein the amount of formulae (A), (B) and (C) is from $5\times10^{-5}$ mol to $1\times10^{-3}$ mol per mol of silver halide.

11. The method as in claim 1, wherein the silver halide emulsion is silver chlorobromide or silver iodochlorobromide containing up to 5 mol % of silver bromide.

12. The method as in claim 1, wherein said developer further contains a developing agent selected from the group consisting of 1-phenyl-3-pyrazolidone developing agents and p-aminophenol developing agents.

13. The method as in claim 1, wherein at least one of $R_{15}$ and $R_{16}$ is substituted with a substituent selected from the group consisting of a halogen atom, an alkyl group, an aryl group, an alkoxy group, an aryloxy group, an alkylthio, an arylthio group, an acyl group, an acylamino group, a nitro group, a cyano group, an oxycarbonyl group, a carboxy group, a sulfo group, a ureido group, a sulfonamido group, a sulfamoyl, a carbamoyl group, an acyloxy group, an amino group, a carbonic ester, a sulfonyl group, a sulfinyl group, a hydroxyl group and $-(L)_m-Y$ where Y represents a group promoting adsorption onto the silver halide; L represents a divalent linking group and M represents 0 or 1.

14. The method as in claim 1, wherein at least one of Z and Y in formulae (A), (B) and (C) is substituted with a substituent selected from the group consisting of a methyl group, an ethyl group, an aryl group, an alkoxy group having 1 to 8 carbon atoms, a halogen atom, a nitro group, an amino group and a carboxyl group.

15. A method for forming a silver image in a black and white photographic material, comprising:

imagewise exposing a silver halide black and white photographic material comprising a support having thereon one or more hydrophilic colloid layers, wherein at least one hydrophilic colloid layer is a silver halide emulsion layer comprising silver halide grains with a silver chloride content of at least 90 mol %, and wherein at least one hydrophilic colloid layer comprises a silver halide emulsion layer comprising (A) a compound represented by formula (II); and (B) at least one compound selected from compounds represented by formulae (A), (B) and (C):

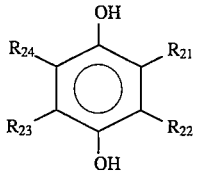

(II)

wherein, $R_{21}$, $R_{22}$, $R_{23}$ and $R_{14}$ each represents a hydrogen atom, a hydroxyl group, an alkoxy group, an aryloxy group, an alkylthio group, an arylthio group, a halogen atom, a primary, secondary or tertiary amino group, a carboxamido group, a sulfonamido group, an alkyl group, an aryl group, a 5-membered or 6-membered heterocyclic group containing at least one N, O or S atom, a formyl group, a keto group, a sulfonic acid group, a carboxylic acid group, an alkylsulfonyl group or an arylsulfonyl group;

$$Z-SO_2-S-M \quad \text{(A)}$$

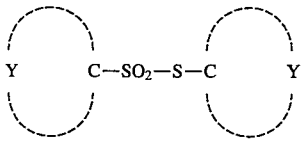

(B)

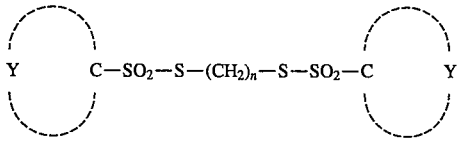

(C)

wherein Z represents an alkyl group having 1 to 18 carbon atoms, an aryl group having 6 to 18 carbon atoms or a heterocyclic group; Y represents an aromatic ring having 6 to 18 carbon atoms or atoms necessary to form a heterocyclic ring; M represents a metal atom or an organic cation; and n represents an integer of 2 to 10; and processing said photographic material with a black and white developer containing a dihydroxybenzene developing agent, wherein the silver halide grains are core/shell silver halide grains having rhodium atoms located in both the core and the shell, the rhodium atoms being present in the core in an amount greater than in the shell.

16. The method as in claim 15, wherein the compound represented by formula (II) is selected from the group consisting of unsubstituted hydroquinone and substituted dihydroxybenzenes which satisfy the requirement that the sum of the Hammett's sigma values of the substituent groups apart from the two hydroxyl groups is −1.2 to +1.2.

17. The method as in claim 15, wherein the compound represented by formula (II) is present in an amount from $1\times10^{-6}$ mol to about $5\times10^{-1}$ mol per mol of silver halide.

18. The method as in claim 17, wherein the compound represented by formula (III) is present in an amount from $1\times10^{-5}$ mol to $8\times10^{-2}$ mol per mol of silver halide.

19. The method as in claim 15, wherein said developer further contains a developing agent selected from the group consisting of 1-phenyl-3-pyrazolidone developing agents and p-aminophenol developing agents.

20. The method as in claim 15, wherein at least one of Z and Y in formulae (A), (B) and (C) is substituted with a substituent selected from the group consisting of a methyl group, an ethyl group, an aryl group, an alkoxy group having 1 to 8 carbon atoms, a halogen atom, a nitro group, an amino group and a carboxyl group.

21. A method for forming a silver image in a black and white photographic material, comprising:

imagewise exposing a silver halide black and white photographic material comprising a support having thereon one or more hydrophilic colloid layers, wherein at least one hydrophilic colloid layer is a silver halide emulsion layer comprising silver halide grains with a silver chloride content of at least 90 mol %, and wherein at least one hydrophilic colloid layer comprises a silver halide emulsion layer comprising (A) a compound represented by formula (III); and (B) at least one compound selected from compounds represented by formulae (A), (B) and (C):

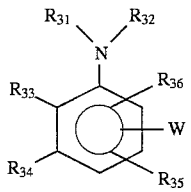

(III)

wherein W represents OH or $N(R_{31})R_{32}$, $R_{31}$ and $R_{32}$ each represents a hydrogen atom, an alkyl group, an aryl group, an alkylsulfonyl group, an arylsulfonyl group, an alkylcarbonyl group, an arylcarbonyl group or a carbamoyl group; $R_{31}$ and $R_{32}$ may be identical or different and may link to form a nitrogen-containing hetero ring; and $R_{33}$, $R_{34}$, $R_{35}$ and $R_{36}$ each represents a hydrogen atom or a substituent group selected from the group consisting of a halogen atom, an alkyl group, an aryl group, an alkoxy group, an aryloxy group, an alkylthio, an arylthio group, an acyl group, an acylamino group, a nitro group, a cyano group, an oxycarbonyl group, a carboxy group, a sulfo group, a ureido group, a sulfonamido group, a sulfamoyl, a carbamoyl group, an acyloxy group, an amino group, a carbonic ester, a sulfonyl group, a sulfinyl group; $R_{33}$, $R_{34}$, $R_{35}$ and $R_{36}$ may be identical or different; and $R_{33}$ and $R_{34}$ may link to form a 5- to 7-membered carbocyclic or heterocyclic ring wherein these rings may be saturated or unsaturated;

$$Z-SO_2-S-M \quad \text{(A)}$$

-continued

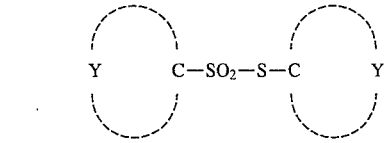

(B)

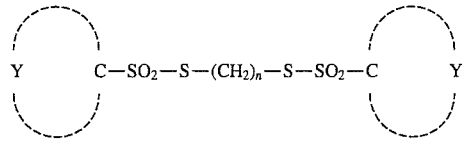

(C)

wherein Z represents an alkyl group having 1 to 18 carbon atoms, an aryl group having 6 to 18 carbon atoms or a heterocyclic group; Y represents an aromatic ring having 6 to 18 carbon atoms or atoms necessary to form a heterocyclic ring; M represents a metal atom or an organic cation; and n represents an integer of 2 to 10; and processing said photographic material with a black and white developer containing a dihydroxybenzene developing agent, wherein the silver halide grains are core/shell silver halide grains having rhodium atoms located in both the core and the shell, the rhodium atoms being present in the core in an amount greater than in the shell.

22. The method as in claim 21, wherein the compound represented by formulae (III) is present in an amount of about $1\times10^{-5}$ mol to about $1\times10^{-1}$ mol per mol of silver halide.

23. The method as in claim 22, wherein the compound represented by formula (III) is present in an amount of from $1\times10^{-4}$ mol to $5\times10^{-2}$ mol per mol of silver halide.

24. The method as in claim 21, wherein said developer further contains a developing agent selected from the group consisting of 1-phenyl-3-pyrazolidone developing agents and p-aminophenol developing agents.

25. The method as in claim 21, wherein at least one of Z and Y in formulae (A), (B) and (C) is substituted with a substitutent selected from the group consisting of a methyl group, an ethyl group, an aryl group, an alkoxy group having 1 to 8 carbon atoms, a halogen atom, a nitro group, an amino group and a carboxyl group.

* * * * *